US006599142B2

(12) United States Patent
Bu

(10) Patent No.: US 6,599,142 B2
(45) Date of Patent: Jul. 29, 2003

(54) CARD EDGE CONNECTOR WITH IMPROVED EJECTOR MECHANISM

(75) Inventor: Xue-Wu Bu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/999,657

(22) Filed: Oct. 31, 2001

(65) Prior Publication Data

US 2003/0073332 A1 Apr. 17, 2003

(30) Foreign Application Priority Data

Oct. 12, 2001 (TW) ..... 90217384 U

(51) Int. Cl.[7] ..... H01R 13/62
(52) U.S. Cl. ..... 439/157; 439/160
(58) Field of Search ..... 439/159, 160, 439/152–158, 326, 329, 372, 157

(56) References Cited

U.S. PATENT DOCUMENTS 5,302,133 A * 4/1994 Tondreault ..... 439/157
5,443,394 A * 8/1995 Billman et al. ..... 439/157
5,690,499 A * 11/1997 Howell et al. ..... 439/157
6,200,149 B1 * 3/2001 Chi-Chung ..... 439/160

* cited by examiner

*Primary Examiner*—Hien Vu
(74) *Attorney, Agent, or Firm*—Wei Te Chung

(57) ABSTRACT

The card edge connector (1) comprises an insulative housing (2) with a number of terminals (3) retained therein, and a pair of ejector mechanisms (4) pivotally attached to opposite ends of the housing. Each ejector mechanism includes a body portion (40), an abutment (42) and a handle (45). The body portion defines a channel (46) between the abutment and the handle. The channel comprises an upper channel (460) and a lower channel (462). The lower channel has a smaller width than that of the upper channel.

1 Claim, 4 Drawing Sheets

CARD EDGE CONNECTOR WITH IMPROVED EJECTOR MECHANISM

BACKGROUND OF THE INVENTION

1. Field of the Invention

The present invention relates to a card edge connector, and particularly to a card edge connector having ejector mechanisms for ejection of an inserted card therefrom.

2. Description of Related Art

Card edge connectors are used in computers and other electronic devices for establishing an electrical connection between a main printed circuit board (usually called a mother board) and a card (usually called a daughter board). Referring to FIG. 4, a conventional card edge connector 1' comprises an insulative housing 2', a plurality of terminals 3' retained in the housing 2' for electrically connecting with a card 5', and a pair of ejector mechanisms 4' pivotally attached to opposite ends of the housing 2' for ejection of the card 5' from the connector 1'. Each ejector mechanism 4' includes a body portion 40', an abutment 42' at one end of the body portion 40', and a handle 45' at an opposite end of the body portion 40'. The body portion 40' has a pair of pivots 400' formed on opposite sides thereof for engaging with a corresponding pair of holes 212' defined in the housing 2'. The body portion 40' also defines a channel 46' having a certain wide width for providing sufficient flexibility to facilitate mounting of the ejector mechanism 4' to the housing 2'. The channel 46' is equal in width along a longitudinal axis thereof. To eject the card 5' from the connector 1', an external force is exerted on the handles 45' to rotate outwardly the ejector mechanisms 4' about the pivots 400'. During the rotation of the ejector mechanisms 4', the abutments 42' push the card 5' to move upwardly until the card 5' is completely ejected from the terminals 3' of the connector 1'.

However, the abutment-to-pivot distance is smaller than the handle-to-pivot distance, which results in a relatively small moment arm. According to the principle of leverage, the smaller the moment arm is, the larger the force is. Therefore, when ejecting the card 5' from the connector 1', a relatively large force is applied to a lower body portion located between the pivot 400' and the abutment 42'. Because the width of the channel 46' is large, the mechanical strength of the lower body portion is weak due to its reduced thickness. As a result, the lower body portion of the ejector mechanism 4' is easy to be broken during the process of ejecting the card 5'.

Hence, a card edge connector with improved ejector mechanisms is required to overcome the disadvantages of the related art.

SUMMARY OF THE INVENTION

Accordingly, the object of the present invention is to provide a card edge connector having improved ejector mechanisms, the ejector mechanism having large mechanical strength for preventing breakage.

In order to achieve the object set forth, a card edge connector in accordance with the present invention comprises an insulative housing defining a slot for receiving a daughter board therein and a plurality of terminal-receiving passageways each in communication with the slot, a plurality of terminals received in the passageways each including a mating portion extending into the slot for electrical connection with the daughter board and a tail portion extending beyond a mounting face of the housing for electrical connection with a motherboard, and a pair of ejector mechanisms pivotally, attached to the housing. Each ejector mechanism includes a body portion, a handle at one end of the body portion, and an abutment at an opposite end of the body portion. The body portion defines a channel between the handle and the abutment to divide the body portion into a first and a second body portions. A lower section of each of the first body portion and the second body portion has a larger thickness than that of an upper section thereof.

Other objects, advantages and novel features of the invention will become more apparent from the following detailed description when taken in conjunction with the accompanying drawings.

DETAILED DESCRIPTION OF THE INVENTION

Figure 1:
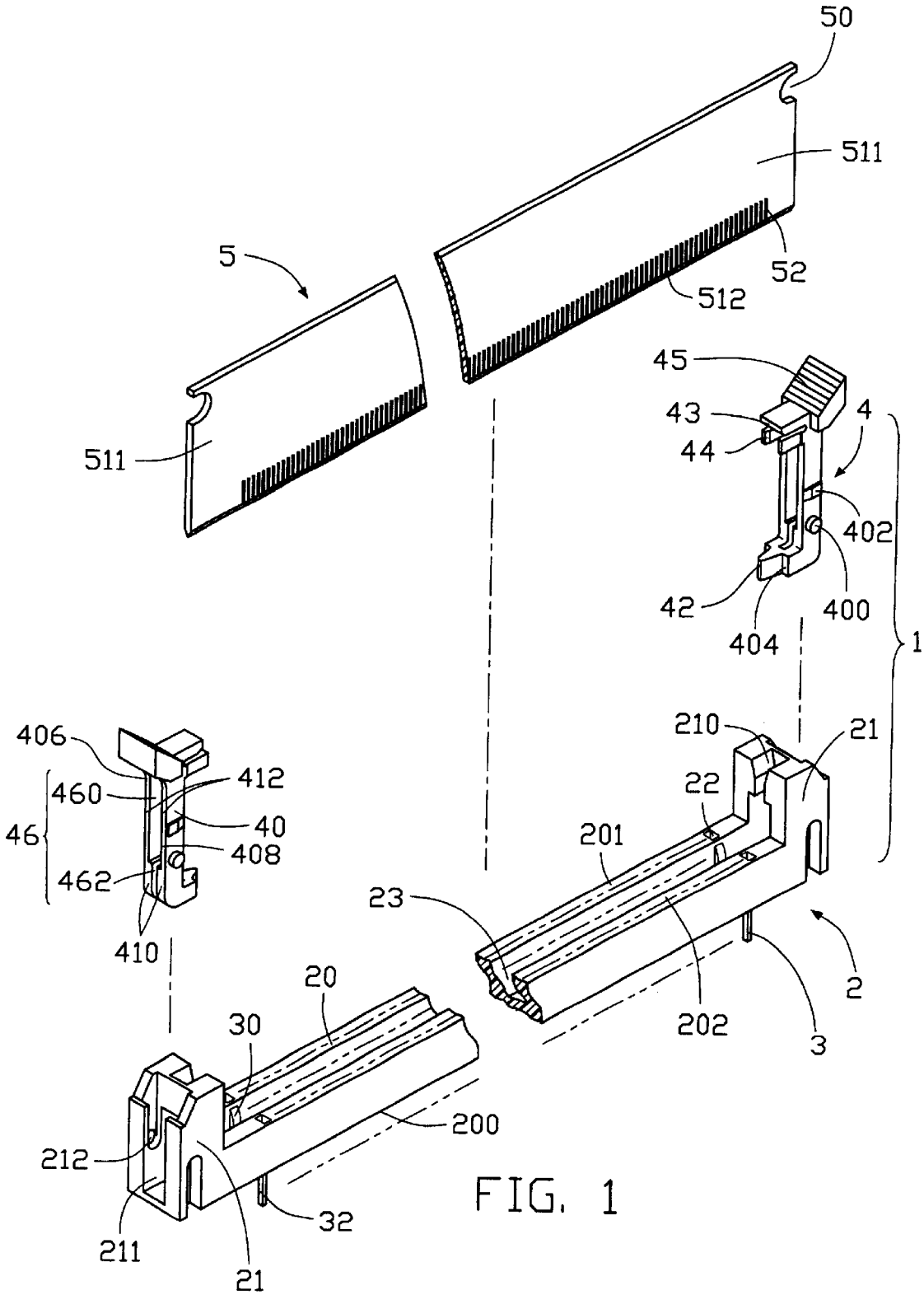
FIG. 1 is an exploded, perspective view of a card edge connector having a pair of ejector mechanisms in accordance with the present invention and a card.
Figure 3:
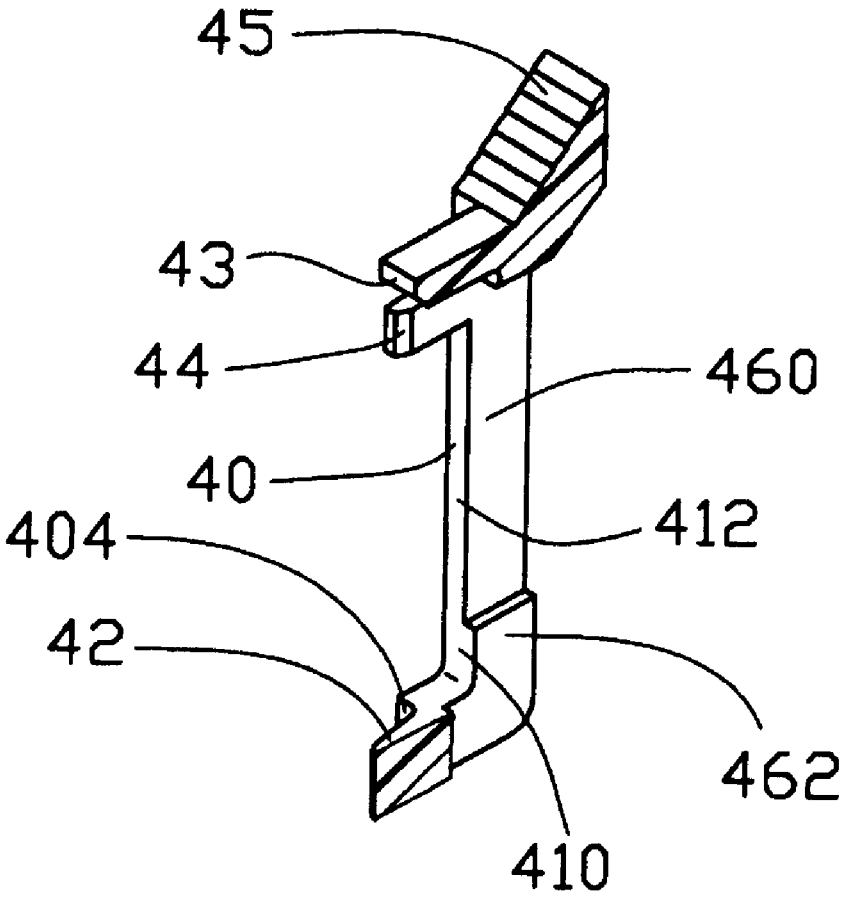
FIG. 3 is a perspective, cut-away view of the ejector mechanism shown in FIG. 1.

Referring to FIGS. 1 and 3, a card edge connector 1 having a pair of ejector mechanisms 4 in accordance with the present invention is shown. The card edge connector 1 comprises an insulative housing 2, a plurality of terminals 3 received in the housing 2, and a pair of ejector mechanisms 4 pivotally mounted on opposite ends of the housing 2.

The housing 2 is generally of a U-shaped configuration, and comprises a middle elongated section 20 and a pair of guiding projections 21 upwardly extending from opposite ends of the middle section 20. The middle section 20 defines a card-receiving slot 23 in a longitudinal direction thereof. The card-receiving slot 23 divides the middle section 20 into a first and a second parts 201, 202. Each part 201, 202 has a sufficient thickness to define a plurality of terminal-receiving passageways 22 in communication with the slot 23 for accommodating the terminals 3 therein. Each guiding projection 21 defines a guiding channel 210 in communication with the slot 23 for guiding and positioning a daughter board 5, a chamber 211 in an outer side thereof communicating with the guiding channel 210 for receiving the ejector mechanism 4, and a pair of holes 212 on opposite sides of the chamber 211.

The terminals 3 are received in the terminal-receiving passageways 22. Each terminal 3 includes a mating portion 30 extending into the slot 23 for electrical connection with a corresponding gold finger 52 of the daughter board 5, a retention portion (not shown) retained in the housing 2, and a tail portion 32 extending beyond a mounting face 200 of the housing 2 for electrically connecting with a mother board (not shown).

The ejector mechanisms 4 are pivotally attached to the guiding projections 21 of the housing 2. Each ejector mechanism 4 comprises a body portion 40, an abutment 42 at one end of the body portion 40, and an inwardly extending tongue 43, a pair of inwardly extending tabs 44 and an outwardly extending handle 45 at an opposite end of the body portion 40. A gap substantially equal to the thickness of the daughter board 5 is defined between the tabs 44. The body portion 40 has a contacting face 404 from which the abutment 42 extends inwardly. The body portion 40 has a pair of pivots 400 and a pair of projections 402 formed on opposite sides thereof. The distance between the projections 402 is slightly larger than the width of the chamber 211. The body portion 40 defines a channel 46 in a middle section along a longitudinal direction thereof to divide the body portion 40 into a first and a second body portions 406, 408. A lower section 410 of each of the first body portion 406 and the second body portion 408 has a larger thickness than that of an upper section 412 thereof. The channel 46 comprises an upper channel 460, and a lower channel 462 located below the pivot 400. The lower channel 462 has a smaller width than that of the upper channel 460.

Figure 2:
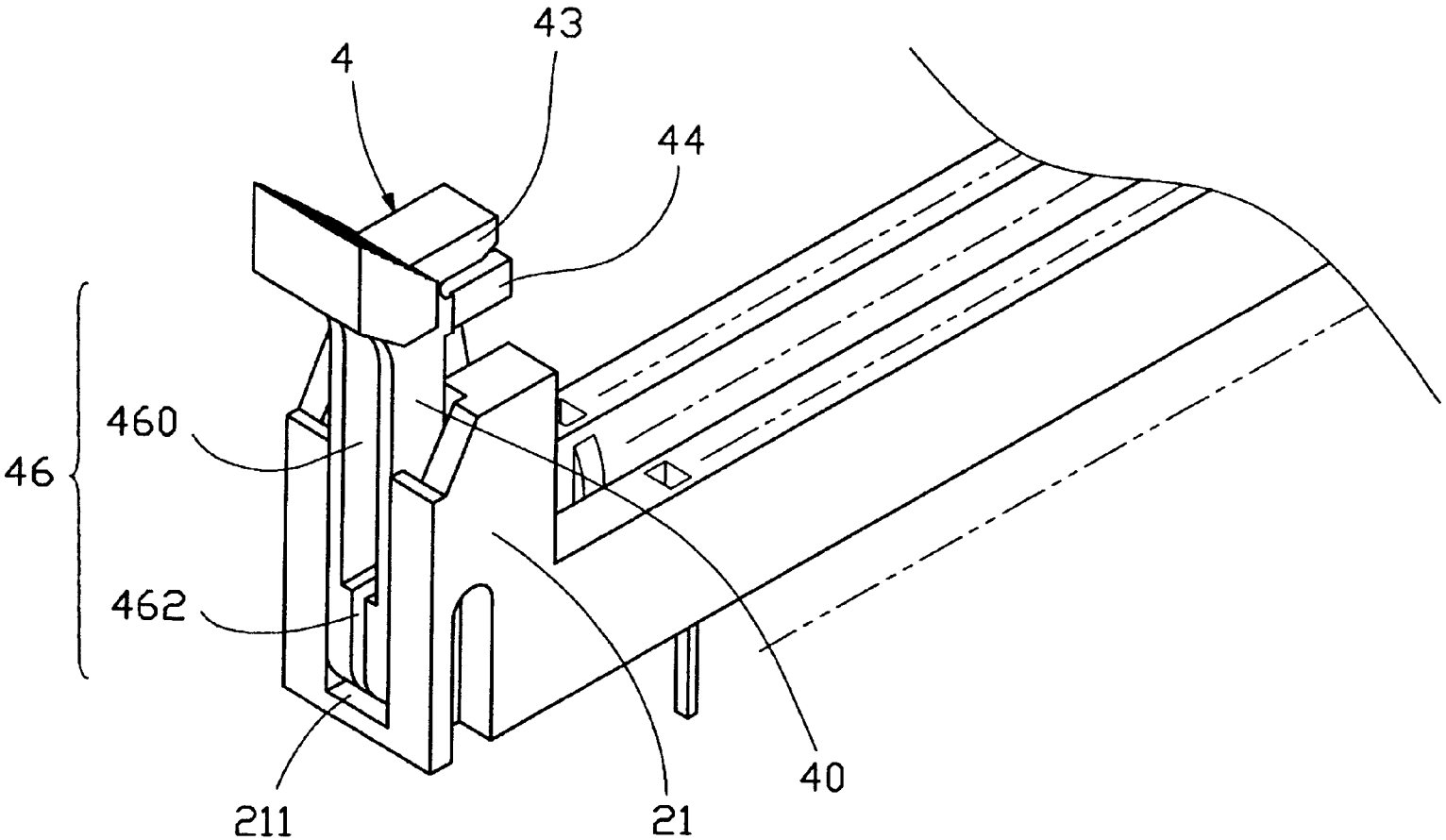
FIG. 2 is an assembled view of the card edge connector of FIG. 1.

Further referring to FIG. 2, in assembly, the ejector mechanisms 4 are accommodated in the chambers 211. The body portion 40 has good flexibility due to the channel 46 in order to facilitate insertion of the ejector mechanism 4 into the chamber 211. The pivots 400 of the ejector mechanism 4 are received in the holes 212 of a corresponding guiding projection 21 to pivotally attach the ejector mechanism 4 to the housing 2. The pair of projections 402 abut against the two sides of the chamber 211 for securely retaining the ejector mechanism 4 therein.

Before inserting the daughter board 5 into the slot 23 of the connector 1, an external force is exerted on the handles 45 to push the ejector mechanisms 4 to pivot outwardly about the pivots 400. The daughter board 5 is guided into the slot 23 by the guiding channels 210 of the guiding projections 21, and the mating portions 30 of the terminals 3 reliably connect with the gold fingers 52 of the daughter board 5. The abutment 42 of each ejector mechanism 4 is downwardly pressed by a lower edge 512 of the daughter board 5, resulting in an inwardly pivotal movement of the ejector mechanism 4. The tabs 44 of each ejector mechanism 4 engage opposite sides 511 of the daughter board 5 and the tongue 43 is received in a cutout 50 defined in each opposite side 511 of the daughter board 5, thereby securely retaining the daughter board 5 in the connector 1.

To eject the daughter board 5 from the connector 1, an external force is exerted on the handles 45 to push the ejector mechanisms 4 to pivot outwardly about the pivots 400. The tongue 43 and the tabs 44 of each ejector mechanism 4 respectively disengage from the cutout 50 and the opposite sides 511 of the daughter board 5. At the same time, the abutment 42 of the ejector mechanism 4 pushes the daughter board 5 to move upwardly until the contacting face 404 abuts against a corresponding protrusion (not shown) formed in the housing 2, whereby the daughter board 5 is ejected from the slot 23.

Figure 4:
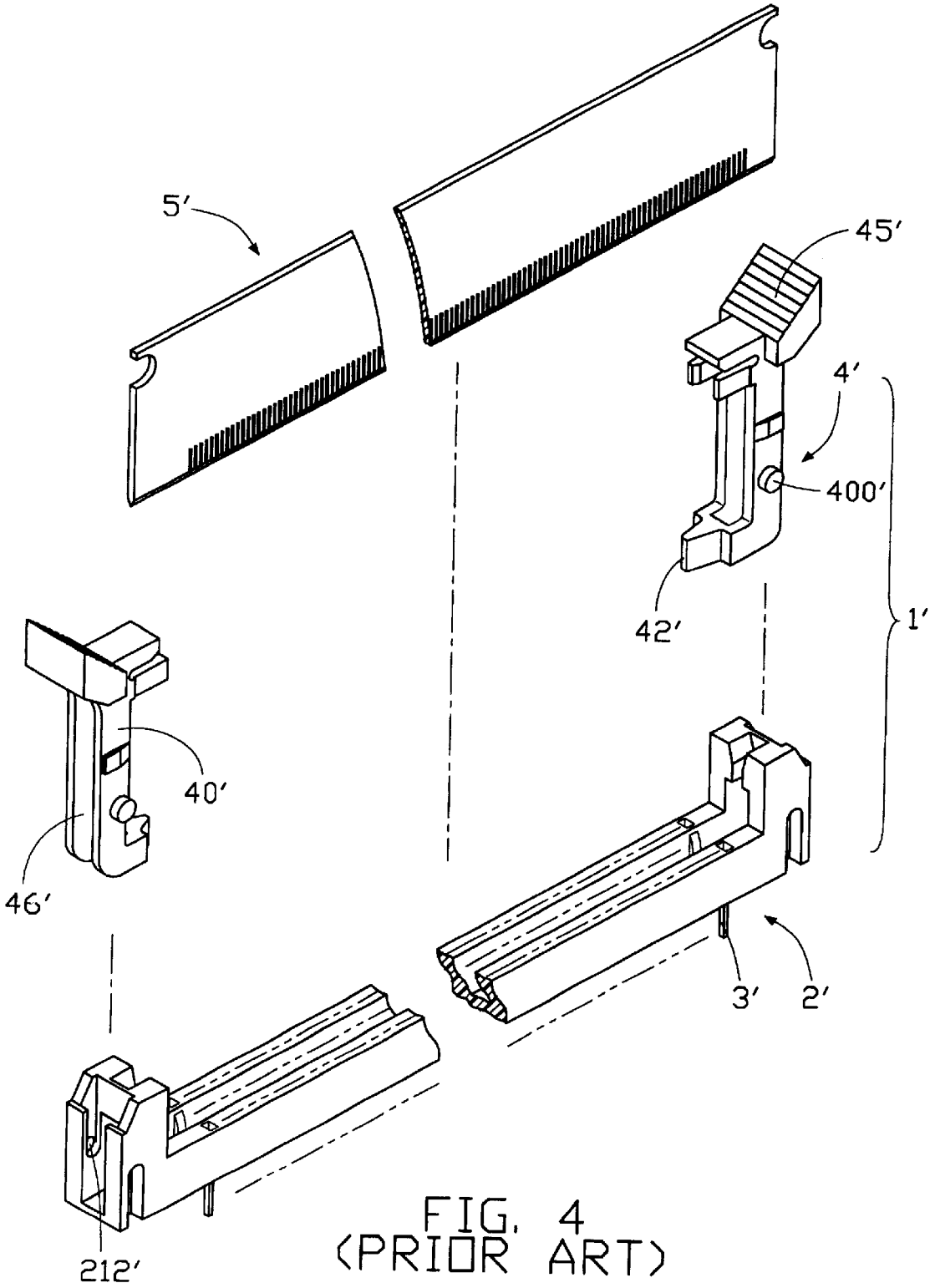
FIG. 4 (PRIOR ART)
FIG. 4 is an exploded, perspective view of a conventional card edge connector and a card.

Because the lower channel 462 has a smaller width than that of the upper channel 460, i.e., the thickness of a lower body portion at the lower channel 462 is increased, the mechanical strength of the lower body portion is greatly increased. Furthermore, experimental data indicates that, when the thickness of the lower body portion is increased, the ejector mechanism 4 can endure an external force ranging between 0.5 and 0.6 kilogram. However, according to the prior design of FIG. 4 where the thickness of the lower body portion is small, the ejector mechanism 4 is generally broken at an external force ranging between 0.2 and 0.3 kilogram. Thus, by the arrangement of the present invention, the ejector mechanism 4 will not be apt to break even when the lower body portion of the ejector mechanism 4 is subject to a large force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for establishing an electrical connection between a mother board and a daughter board, comprising;

an insulative housing defining a slot adapted for receiving a daughter board and a plurality of terminal-receiving passageways each in communication with the slot;

a plurality of terminals received in the passageways, each terminal including a mating portion and a tail portion; and a pair of ejector mechanisms pivotally attached to the housing, each ejector mechanism including a body portion, a handle for being exerted on by an external force and an abutment adapted for abutting against the daughter board, a pair of pivots formed on opposite sides of the body portion, the body portion defining a channel between the handle and the abutment to divide the body portion into a first and a second body portions, each of the first body portion and the second body portion having an upper and a lower sections respectively located above and below the pivots, the lower section having a larger thickness than that of the upper section; wherein the channel comprises an upper channel and a lower channel respectively located above and below the pivots, the lower channel having a smaller width than that of the upper channel, wherein the lower channel has a vertical portion and a horizontal portion, wherein the vertical and horizontal portions are positioned around a bottom portion of the body portion; wherein the insulative housing comprises a pair of guiding projections on opposite ends thereof, each guiding projection defining a chamber for receiving the body portion of a corresponding ejector mechanism and a pair of holes in communication with the chamber for receiving the pivots.

* * * * *